US005261192A

United States Patent [19]

Nelson

[11] Patent Number: 5,261,192

[45] Date of Patent: Nov. 16, 1993

[54] SURFACE CLEANING APPARATUS

[75] Inventor: Robert T. Nelson, Oklahoma City, Okla.

[73] Assignee: Nelco Manufacturing Corp., Oklahoma City, Okla.

[21] Appl. No.: 836,636

[22] Filed: Feb. 14, 1992

[51] Int. Cl.[5] ..... B24C 3/06; B24C 9/00

[52] U.S. Cl. ..... 51/429; 51/425; 51/415

[58] Field of Search ..... 51/429, 410, 424, 425, 51/415, 165.71

[56] References Cited

U.S. PATENT DOCUMENTS

| | | | |
|---|---|---|---|
| 2,204,610 | 6/1940 | Minich | 51/9 |
| 2,254,234 | 9/1941 | Minich | 51/9 |
| 2,635,745 | 4/1953 | Mead et al. | 209/35 |
| 2,684,558 | 7/1954 | Harris . | |
| 2,741,878 | 4/1956 | Morain | 51/429 |
| 2,766,557 | 10/1956 | Pollard | 51/8 |
| 2,850,162 | 9/1958 | Widmer | 209/134 |
| 3,034,262 | 5/1962 | Pawlson | 51/9 |
| 3,262,228 | 7/1966 | Schenck | 51/9 |
| 3,380,196 | 4/1968 | Mabille | 51/9 |
| 3,608,968 | 9/1971 | Burnett | 299/39 |
| 3,756,377 | 9/1973 | Goff | 51/9 |
| 3,858,359 | 1/1975 | Leliaert | 51/429 |
| 3,877,175 | 4/1975 | Snyder | 51/9 |
| 3,900,969 | 8/1975 | Diehn | 51/9 |
| 3,906,673 | 9/1975 | Goto | 51/9 |
| 3,934,372 | 1/1976 | Diehn | 51/8 |
| 3,934,373 | 1/1976 | Leliaert | 51/9 |
| 3,977,128 | 8/1976 | Goff | 51/9 |
| 3,981,104 | 9/1976 | Dreher | 51/9 |
| 4,019,284 | 4/1977 | Hileman | 51/429 |
| 4,020,596 | 5/1977 | Bergh | 51/9 |
| 4,035,958 | 7/1977 | Nishio | 51/425 |
| 4,052,820 | 10/1977 | Bergh | 51/423 |
| 4,092,942 | 6/1978 | Kurohiji | 51/425 |
| 4,222,205 | 9/1980 | Lake et al. | 51/420 |
| 4,309,850 | 1/1982 | Benson | 51/429 |
| 4,319,436 | 3/1982 | Van Fossen | 51/429 |
| 4,336,671 | 6/1982 | Nelson | 51/424 |
| 4,364,823 | 12/1982 | Goff | 209/135 |
| 4,376,358 | 3/1983 | Shelton | 51/429 |
| 4,377,922 | 3/1983 | Bergh | 51/424 |
| 4,377,923 | 3/1983 | Bergh | 51/424 |
| 4,377,924 | 3/1983 | Bergh | 51/429 |
| 4,382,352 | 5/1983 | Nelson | 51/424 |
| 4,416,092 | 11/1983 | Nelson | 51/425 |
| 4,941,296 | 7/1990 | Carpenter | 51/433 |

FOREIGN PATENT DOCUMENTS

| | | |
|---|---|---|
| 32161 | 7/1981 | European Pat. Off. . |
| 2900 | of 1870 | United Kingdom . |
| 487532 | 6/1938 | United Kingdom . |
| 2203368 | 3/1988 | United Kingdom . |

*Primary Examiner*—Bruce M. Kisliuk
*Assistant Examiner*—Bo Bounkong
*Attorney, Agent, or Firm*—Dunlap, Codding & Lee

[57] ABSTRACT

An apparatus for cleaning a surface comprises a truck with a hydraulic system and a trailer with a blast assembly, dust collector and electric power generator. The apparatus is configurable into an operating mode and a transport mode. In the operating mode, the apparatus is driven by means of the hydraulic system, the blast assembly is lowered to the surface by a hydraulic cylinder and the blast assembly extends beyond the width of the trailer to clean a wide area. Abrasive material is propelled against the surface by a plurality of motor-driven centrifugal blast wheels and is returned for reuse by a return auger and an elevator. Air flow created by the dust collector facilitates return of spent abrasive material for reuse. In another preferred embodiment, a recapture assembly is attached to the blast assembly to capture abrasive material escaping between the blast assembly and the surface to be cleaned. In the transport mode, the apparatus is driven by the truck without use of the hydraulic system, the elevator is pivoted to an inclined position, and the blast assembly is both retracted toward the trailer and rotated to be entirely beneath the trailer.

19 Claims, 10 Drawing Sheets

SURFACE CLEANING APPARATUS

FIELD OF THE INVENTION

This invention relates to machines for cleaning surfaces and particularly to an apparatus having an extended width when operating to clean a surface.

SUMMARY OF THE INVENTION

An apparatus constructed in accordance with the present invention comprises a truck and trailer with a hydraulic system, a supply system for feeding abrasive material to a blast assembly, an elevator, a dust collector and an electric power generator. The blast assembly includes a plurality of centrifugal blast wheels mounted in a blast housing.

The hydraulic system is provided to move the apparatus at a constant rate of travel in the operating mode regardless of the terrain of the surface to be cleaned. In addition, the hydraulic system drives a hydraulic cylinder and piston for lowering the blast assembly to the surface to be cleaned and for raising the blast assembly from the surface.

The dust collector draws dust-laden air from the blast assembly and elevator, filters dust from the air, and removes the dust from the apparatus. Air flow created by the dust collector facilitates the return of abrasive material from the surface to be cleaned to the supply system for reuse.

The apparatus is configurable into an operating mode for cleaning a surface and a transport mode for moving the apparatus from one job location to another. In the operating mode, the blast mechanism is lowered to the surface to be cleaned and extends beyond the width of the trailer to clean a path wider than the width of the trailer. When operating, the elevator is in a substantially vertical position and is attached to the blast housing to lift abrasive material from the blast housing to the supply system in order to reuse the abrasive material.

In the transport mode, the elevator is detached from the blast housing and is pivoted to an inclined position. The blast assembly is raised from the surface and is rotated to be entirely beneath the trailer.

A major advantage of the present invention is that the apparatus operates to clean a path wider than the width of the trailer yet travels between job locations at a width no wider than the trailer. This construction allows cleaning a larger area with fewer passes and in less time than is possible with conventional cleaning machines.

Another advantage is that the dust collector prevents escape to the environment of dust and debris resulting from the cleaning process.

Yet another advantage is that the hydraulic system is utilized to achieve a constant rate of travel regardless of the gradient of the surface of the surface to be cleaned. The consistent rate of travel results in a uniformly cleaned surface.

Other features and advantages are apparent from the following description when read in conjunction with the accompanying drawings and appended claims.

BRIEF DESCRIPTION OF THE DRAWINGS

FIG. 18 is a diagrammatical side view illustrating the travel path of abrasive material in an apparatus constructed in accordance with the present invention.

FIG. 19 is a side elevation of a middle portion of an apparatus constructed in accordance with the present invention and configured in transport mode.

DETAILED DESCRIPTION OF THE PREFERRED EMBODIMENTS

Figure 1:
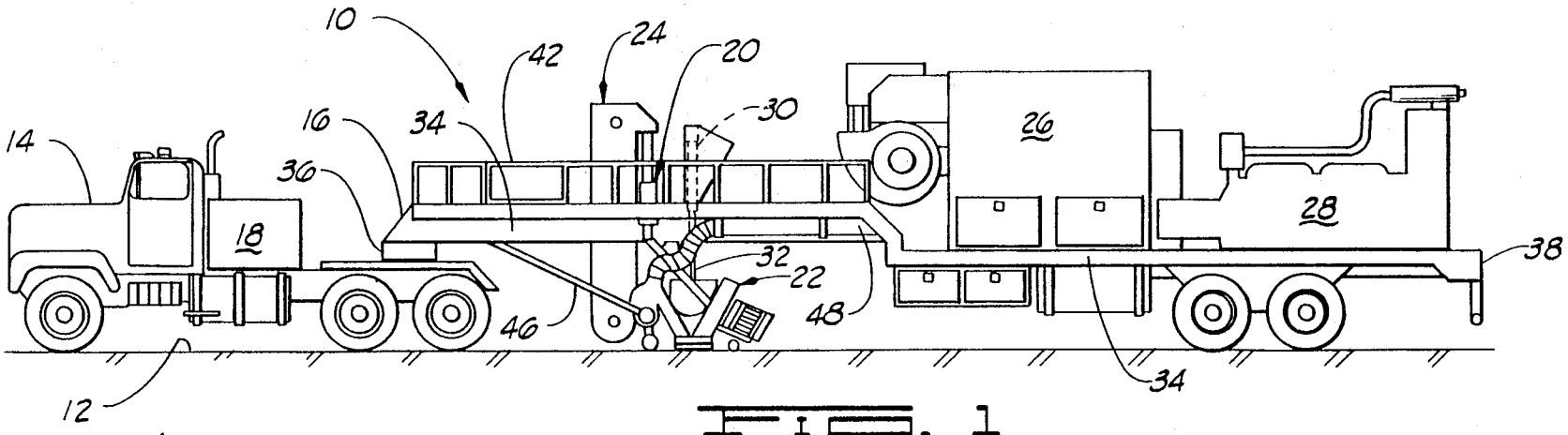
FIG. 1 is a side elevation of an apparatus constructed in accordance with the present invention and configured in operating mode.
Figure 2:
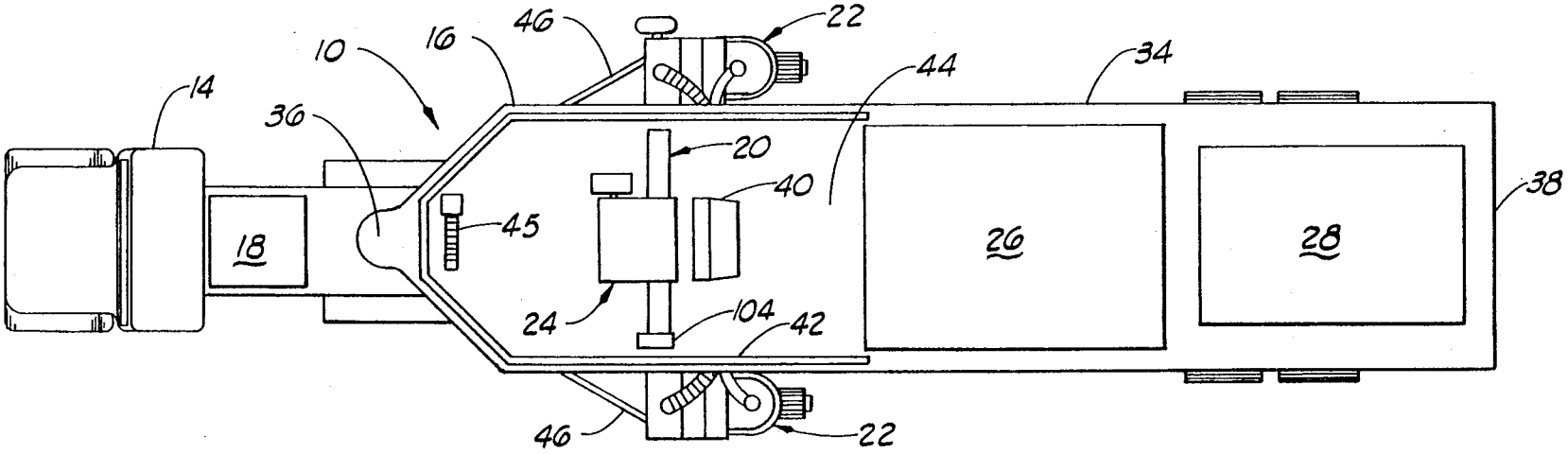
FIG. 2 is a top plan view of the apparatus of FIG. 1.

Referring now to the drawings in detail and to FIGS. 1 and 2 in particular, reference character 10 generally designates an apparatus constructed in accordance with the present invention. As described hereinbelow, the apparatus 10 is capable of being configured in an operating mode for cleaning a surface 12 or a transport mode for moving the apparatus 10 from one job location to another.

OPERATING MODE

As shown in FIGS. 1 and 2, the apparatus 10 is configured in the operating mode to clean the surface 12. The apparatus 10 comprises a truck 14 adapted for pulling a trailer 16. A conventional hydraulic system 18 is mounted on the truck 14 to provide hydraulic power for the apparatus 10. A supply system 20, a blast assembly 22, an elevator 24, a dust collector 26, and an electric power generator 28 are mounted to the trailer 16.

The hydraulic system 18 includes a hydraulic fluid reservoir, hydraulic pump, centrifugal clutch, gear box, hydraulic lines and hydraulic controls assembled in a manner which is known in the art. The hydraulic system 18 also includes a conventional electrohydraulic controller, which enables the hydraulic system 18 to operate hydraulic valves in response to electrical inputs. The hydraulic system 18 is adapted to be connected to the drive train of the truck 14 to power the motion of the truck 14 and trailer 16 when in the operating mode.

In order to propel the truck 14 by means of the hydraulic system 18, a sprocket is rigidly mounted around the drive shaft of the truck 14. Another sprocket is secured around the output drive shaft of the hydraulic system 18. A drive chain is installed around the two sprockets to transfer the rotation of the hydraulic output drive shaft to the drive shaft of the truck 14. In the operating mode, the transmission of the truck is in neutral and the power take-off of the truck 14 is engaged so that the truck engine drives the hydraulic pump of the hydraulic system 18, which in turn moves the drive train of the truck 14 through the chain and sprocket assembly.

In the transport mode, the power take-off of the truck 14 is disengaged and the drive chain is removed from the sprockets. The truck engine and drive train move the truck 14 in the usual manner.

The hydraulic system 18 is removably connected by hydraulic lines to a hydraulic cylinder 30 with a piston 32. The hydraulic cylinder 30 is mounted to the trailer 16 with the lower end of the piston 32 extending from the hydraulic cylinder 30 to attach to the blast assembly 22.

The trailer 16 includes a frame 34 having a front end 36 attachable to the truck 14 and a wheeled rear end 38. The blast assembly 22 is located beneath the frame 34 and the elevator 24 is pivotally attached to the frame 34 to extend above and below the frame 34. As best shown in FIG. 2, an operator's console 40 is mounted to the top side of the frame 34 and a railing 42 extends around an operator's floor area 44 on the frame 34. A winch 45 is mounted to the frame 34 toward the front end 36 of the trailer 16. FIG. 2 also illustrates that the blast assembly 22, in operating mode, extends well beyond the width of the frame 34 on both sides of the frame 34. Bracing rods 46 are removably attached between the frame 34 and the blast assembly 22 to stabilize the blast assembly 22 as the truck 14 and trailer 16 move over the surface 12 to be cleaned.

To the rear of the blast assembly 22, the dust collector 26 is mounted on the frame 34. A preferred dust collector 26 is disclosed in U.S. Pat. No. 4,618,352, entitled "DUST COLLECTOR," which is hereby incorporated by reference. The dust collector 26 has at least one inlet (not shown) for receiving dust-laden air and a receptacle (not shown) for the accumulation of dust removed from the air by the dust collector 26. As shown in FIG. 1, a conduit 48 leads to the inlet of the dust collector 26.

Continuing to refer to FIGS. 1 and 2, the electric power generator 28 is mounted on the frame 34 behind the dust collector 26. The generator 28 preferably has an output capacity in the range of 500 kilowatts and is adapted with appropriate circuit breakers, transformers and controls for providing power to fans, motors and other electrical equipment of the apparatus 10 in a conventional manner.

Figure 3:
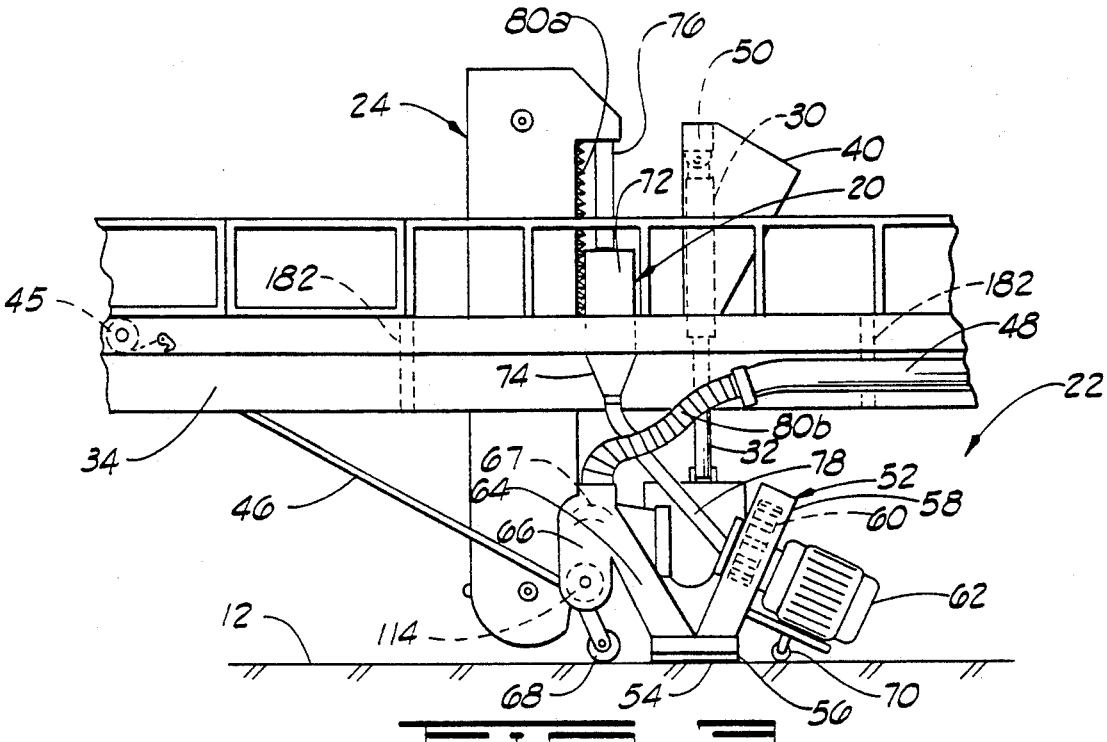
FIG. 3 is a side elevation of a middle portion of the apparatus of FIG. 1.
Figure 4:
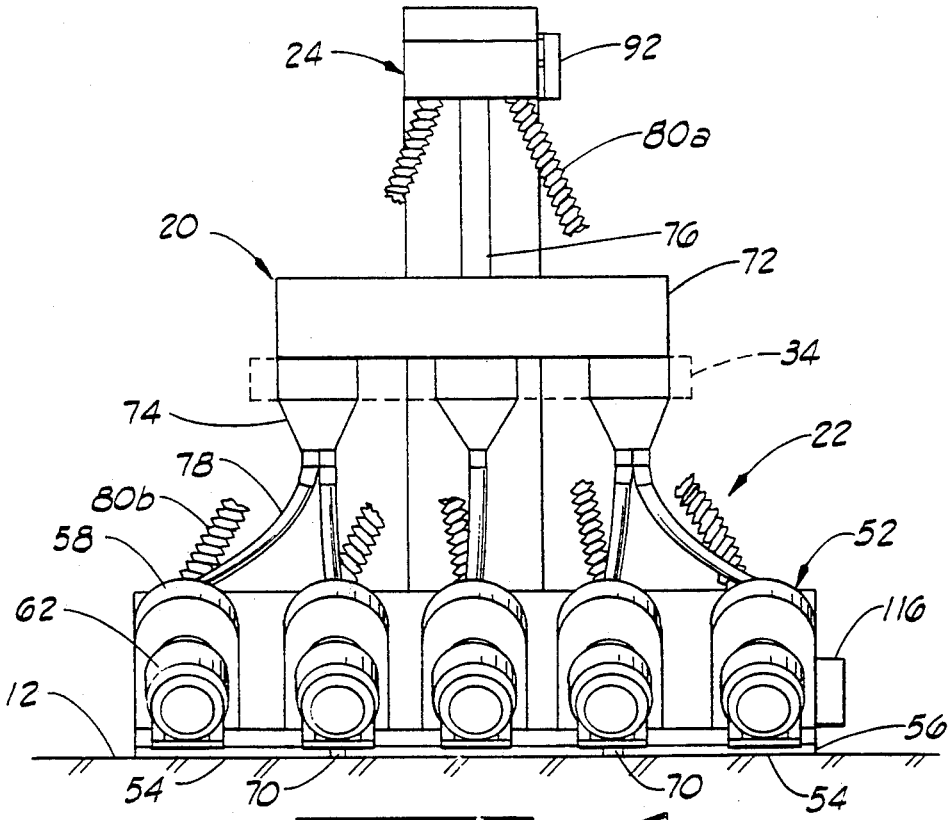
FIG. 4 is a partly diagrammatical rear elevation of the blast assembly of FIG. 3.

FIGS. 3 and 4 illustrate a central portion of the apparatus 10 in the operating position. The piston 32 of the hydraulic cylinder 30 is extended toward the surface 12 until the blast assembly 22 reaches the surface 12 to be cleaned. The hydraulic cylinder 30 is suspended from a beam 50 across the top forward end of the operator's console 40 in a clevis and pin arrangement. The beam 50 is fixed in place by rigid members (not shown) extending from the frame 34 to the beam 50 to support the weight of the blast assembly 22. As best shown in FIG. 3, the top of the hydraulic cylinder 30 is adapted to pivot in the forward/rear directions. In a similar clevis and pin arrangement, the piston 32 is attached to the blast assembly 22 to pivot in the side-to-side direction. These two pivot points allow a degree of movement for the blast assembly 22 to adjust to an uneven areas of the surface 12.

Continuing to refer to FIGS. 3 and 4, the blast assembly 22 comprises a blast housing 52 which is open at the bottom to define a blast opening 54 to the surface 12. The blast opening 54 extends throughout bottom of the blast housing 52. A flexible seal 56, typically a resilient elastomeric seal, surrounds the blast opening 54 to prevent abrasive material from escaping between the blast housing 52 and the surface 12. As best shown in FIG. 4, the blast housing 52 includes a plurality of blast corridors 58. One of the blast corridors is designated by reference numeral 58 and is generally representative of the blast corridors of the blast housing 52. A conventional centrifugal blast wheel 60 (shown in phantom lines in FIG. 3) is mounted within each blast corridor 58. Each blast wheel 60 includes a plurality of radially extending blades for propelling abrasive material fed into the travel path of the blades as the blast wheel 60 rotates. A 50-horsepower electric motor 62 is mounted to each blast corridor 58 and is adapted to drive the rotation of the corresponding blast wheel 60. Although electric motors are typically utilized to drive the blast wheels 60, suitable pneumatic or hydraulic power may be used. In a typical arrangement, five blast wheels 60, each having a 30-inch blast pattern, are utilized to clean a 150-inch wide strip with one pass of the apparatus 10.

As best illustrated by FIG. 3, the blast housing 52 includes a return corridor 64 and a return chamber 66. The lower end of the return corridor 64 communicates with the blast opening 54 and the upper end of the return corridor 64 opens into the return chamber 66. A plurality of deflection plates (shown in dashed lines) extend across the upper end of the return corridor 64 to divert abrasive material downward into the return chamber 66. One of the deflection plates is designated by reference numeral 67 and is generally representative of the deflection plates mounted within the upper end of the return corridor 64. As shown in FIG. 3, the deflection plates 67 are arranged to divert the abrasive material into the return chamber 66 while allowing air flow between the walls of the return corridor 64 and the deflection plates 67.

The blast assembly 22 is supported on a set of front wheels 68 and a set of rear wheels 70 to facilitate movement of the blast assembly 22 over the surface 12. As described hereinabove, the bracing rods 46 are removably attached between the frame 34 and each lateral end of the blast housing 52 to provide structural stability to the blast housing 52.

In the operating mode illustrated by FIGS. 3 and 4, the lower end of the elevator 24 is removably attached to a medial portion of the blast housing 52. The upper end of the elevator 24 extends above and over the supply system 20. As best shown in FIG. 4, the supply system 20 includes a supply bin 72 which communicates with a plurality of feed hoppers positioned beneath the supply bin 72. One of the feed hoppers is designated by reference number 74 and is generally representative of the feed hoppers. A removable resupply duct 76 extends from the upper end of the elevator 24 to the supply bin 72. A plurality of removable feed tubes are provided to carry abrasive material from the feed hoppers 74 to the blast corridors 58. One of the feed tubes is designated by reference number 78 and is generally representative of the removable feed tubes. As best shown in FIG. 4, a typical embodiment utilizes three feed hoppers 74 with five feed tubes 78 and five blast corridors 58, wherein the outside feed hopper 74 on each side supplies abrasive material to two blast corridors 58 and the middle feed hopper 74 supplies the middle blast corridor 58.

Continuing to refer to FIGS. 3 and 4, a plurality of removable dust ducts (partially shown in FIG. 4) communicate with the upper end of the blast housing 52 and the upper end of the elevator 24. One of the dust ducts connected to the upper end of the elevator 24 is indicated by reference character **80*a* and one of the dust ducts attached to the upper end of the blast housing 52 is designated by reference character 80*b*. All of the dust ducts 80*a*–80*b* communicate directly or by way of common ducts to the inlet of the dust collector 26. The dust collector 26 draws air from the elevator 24 and blast housing 52 through the dust ducts 80*a*–80*b*** to collect and remove dust and debris created by the cleaning operation.

Figure 5:
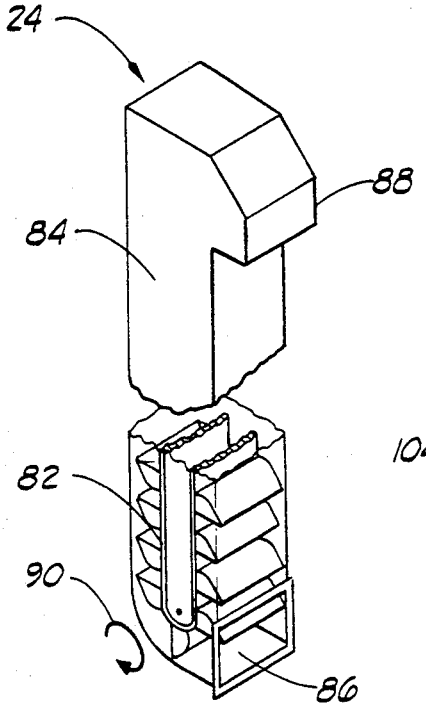
FIG. 5 is a perspective view of the elevator of the apparatus of FIG. 1. A partial cutaway shows a portion of the belt and bucket assembly of the elevator.

FIG. 5 illustrates the elevator 24 separately. The elevator 24 comprises a belt and bucket assembly 82 mounted within an elevator housing 84. A part of the elevator housing 84 is cut away in FIG. 5 to show a portion of the belt and bucket assembly 82. The lower end of the elevator housing 84 has an elevator inlet opening 86 which has a lip adapted to attach to the return chamber 66 of the blast housing 52. The upper end of the elevator housing 84 has a discharge extension 88 with an elevator discharge opening (not shown) to which the resupply duct 76 attaches. The elevator extension 88 also comprises two dust duct openings (not shown) for attachment of dust ducts **80*a* between the elevator 24 and the dust collector 26**.

Continuing to refer to FIG. 5, the belt and bucket assembly 82 is installed within the elevator housing 84. The belt forms a continuous loop from a lower portion to an upper portion of the elevator 24. A plurality of buckets are attached to the belt. As the belt rotates in the direction indicated by arrow 90, the buckets pick up abrasive material at the lower end of the elevator 24 and carry the abrasive material to the upper end of the elevator 24. As best shown in FIG. 4, an electric motor 92 is mounted to the elevator housing 84 to drive the belt and bucket assembly 82 of the elevator 24.

Figure 6:
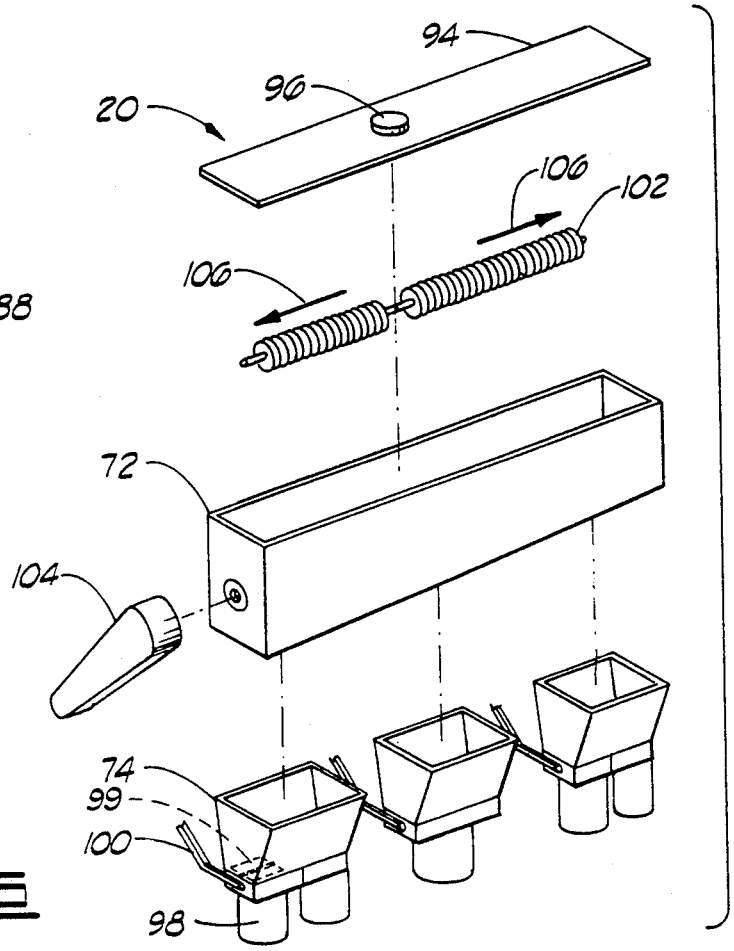
FIG. 6 is exploded perspective view of the supply bin, the supply auger, and the feed hoppers of the apparatus of FIG. 1.

FIG. 6 illustrates the supply system 20 separately. As disclosed hereinabove, the supply system 20 includes the supply bin 72 and the feed hoppers 74. The supply bin 72 has a removable lid 94 with a feed opening 96 adapted for removable attachment of the resupply duct 76. The bottom of the supply bin 72 communicates with the feed hoppers 74 to allow gravity feed of abrasive material from the supply bin 72 into the feed hoppers 74. The feed hoppers 74 are frusto-conical and flat-sided in shape with a gate-controlled discharge chute 98 at the lower end. One of the gates (in dashed lines) is designated by reference number 99 and is generally representative of the feed hopper gates. Each gate 99 is opened and closed by movement of an actuator arm 100 which is controlled and monitored at the operator's console in a conventional manner. The Dayton linear actuator model 4Z843, or its equivalent, is a suitable actuator arm 100 for use with the feed hopper gates 99. As previously described, the two outside feed hoppers 74 include two discharge chutes 98 and feed tubes 78 supplying two blast corridors 58. Accordingly, the two outside feed hoppers 74 have two gates 99 and actuator arms 100 controlling the feed of abrasive material to two blast wheels 60. The gate-controlled hoppers 74 may be used to vary the amount of abrasive material reaching each blast wheel 60 if an uneven blast pattern is desired.

A supply auger 102 may be mounted within the supply bin 72 to distribute abrasive material over the length of the supply bin 72. A motor 104 is provided to rotate the supply auger 102. The rotating supply auger 102 carries abrasive material toward the ends of the supply bin 72 as indicated by direction arrows 106. This arrangement allows the outside feed hoppers 74, which may supply two blast wheels 60, to receive more abrasive material than the middle feed hopper 74.

Figure 7:
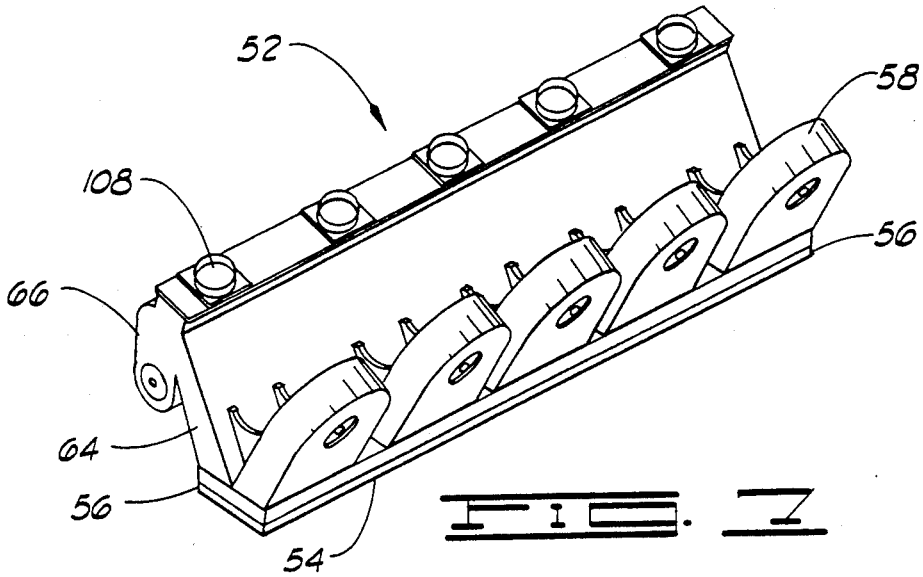
FIG. 7 is a perspective view of the blast housing of the apparatus of FIG. 1.

FIG. 7 illustrates the blast housing 52 separately. Five blast corridors 58 are aligned along the rear end of the blast housing 52 and extend angularly upward from the bottom of the blast housing 52. Each blast corridor 58 is rounded at the upper end and open at the bottom end to communicate with the blast opening 54. The return corridor 64 extends angularly upward from the bottom of the blast housing 52 and toward the front of the blast housing 52. The return corridor 64 communicates with the return chamber 66 extending along the length of the front end of the blast housing 52. A plurality of dust duct openings are formed in the top surface of the blast housing 52 above the return corridor 64 and return chamber 66. One of the dust duct openings is designated by reference numeral 108 and is generally representative of the dust duct openings in the blast housing 52. The dust duct openings 108 are adapted for attachment of the dust ducts **80*b* between the blast housing 52 and the dust collector 26 for drawing air laden with dust and debris from the return corridor 64 and return chamber 66 into the dust collector 26**.

Figure 8:
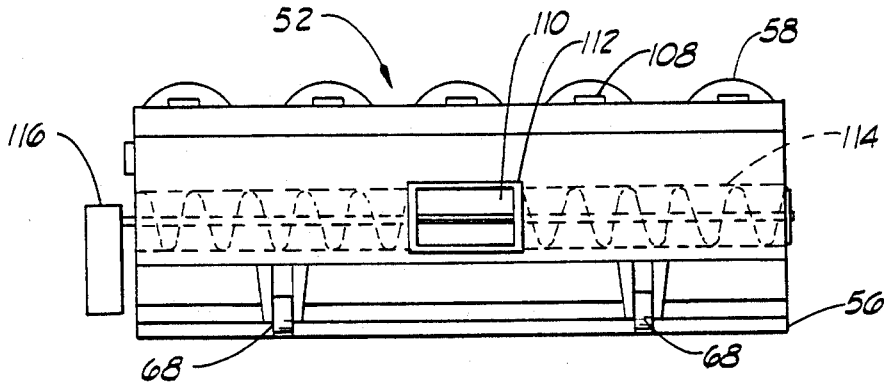
FIG. 8 is a front elevation of the blast housing of FIG. 7.

FIG. 8 shows the front side of the blast housing 52. A return opening 110 is formed at a medial portion of the front side of the return chamber 66. A lip 112 extends around the return opening 110 to mate with and attach to the elevator inlet opening 86. A return auger 114 (shown in dashed lines) extends length-wise in the return chamber 66. A return auger motor 116 is mounted to the blast housing 52 to rotate the return auger 114. The rotation of the return auger 114 conveys abrasive material from the ends of the return chamber 66 through the return opening 110 and into the elevator inlet opening 86.

Figure 9:
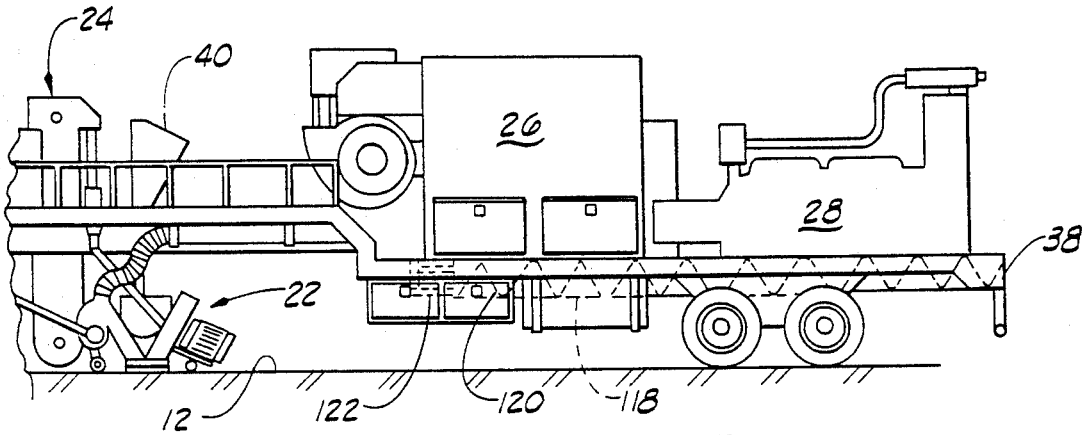
FIG. 9 is a side elevation of a rear portion of the apparatus of FIG. 1.
Figure 10:
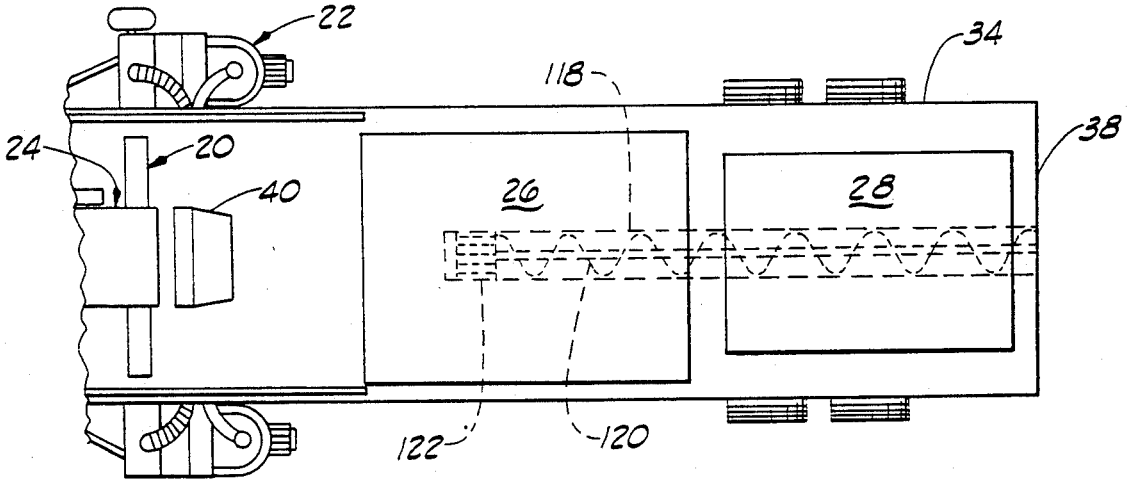
FIG. 10 is a plan view of FIG. 9.

FIGS. 9 and 10 illustrate a rear portion of the apparatus 10 provided with a dust removal channel 118 (shown in phantom). The dust removal channel 118 extends underneath the dust collector 26 and generator 28 from the dust collector 26 to the rear end 38 of the trailer frame 34. The dust removal channel 118 communicates with the dust collector 26 to receive dust and debris from the dust collector 26 and convey the dust and debris to the rear end 38 of the trailer frame 34. A dust removal auger 120 extends within the dust removal channel 118 and a motor 122 is provided to drive the rotation of the dust removal auger 120. The dust removal channel 118 has a dust removal opening at the rear for discharge of the dust. The dust removal opening is adapted for attachment of a cover to prevent escape of dust to the environment when the apparatus 10 is not in use. When the apparatus is in use, a dust bag is attached over the dust removal opening to collect the dust for proper disposal.

OPERATION

The operation of the apparatus 10 is largely controlled by the operator at the operator's console 40. The console 40 includes meters which indicate the flow rate of abrasive material through each feed hopper discharge chute 98 to each blast wheel 60. The console 40 also has a lever for controlling the travel rate of the apparatus 10 through electrical connection to the electro-hydraulic controller of the hydraulic system 18. Another lever is provided on the console 40 for raising and lowering the blast assembly 22 by means of the hydraulic cylinder 30. The console 40 may also include status indicators for the dust collector 26 and the various motors of the apparatus. An emergency off switch is provided to cut power to the apparatus 10 quickly if an abnormal condition arises.

The primary duty of the driver of the truck 14 is to steer the apparatus 10. The driver may depress the accelerator of the truck 14 and increase the input of the truck 14 to the hydraulic system 18. During operation, however, the truck 14 is out of gear and the travel speed is controlled by the operator through the operator's console 40 and the hydraulic system 18. The driver of the truck 14 and the operator at the console 40 are typically in radio contact to coordinate the operation of the apparatus 10.

RECAPTURE AND RETURN OF ABRASIVE MATERIAL

By changing the type of abrasive material and the force with which the abrasive material is propelled, the surface to be cleaned can be cut to various depths. When the cut is less than approximately one-eighth inches deep, the preferred embodiments disclosed hereinabove return substantially all of the abrasive material from the blast opening 54 to the supply bin 72 for reuse. When cutting the surface 12 deeper than approximately one-eighth inches, however, abrasive material tends to escape between the seal 56 of the blast housing 52 and the surface 12. In order to recapture the abrasive material which escapes the blast housing 52, a recapture assembly is provided.

Figure 11:
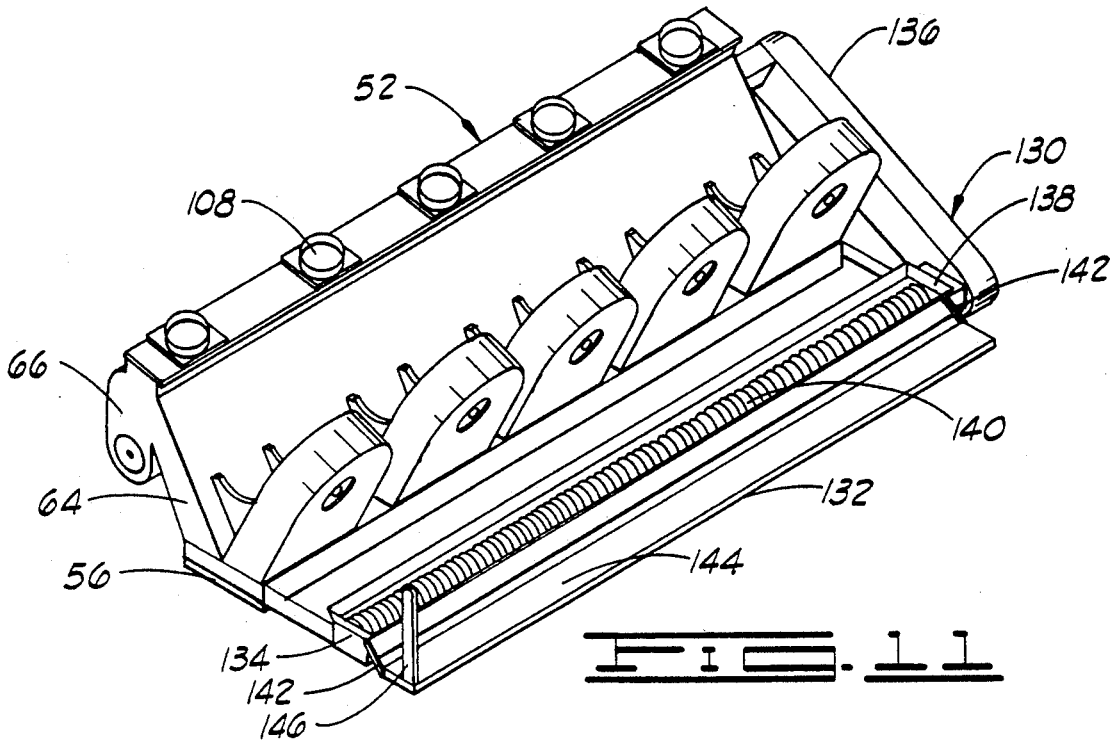
FIG. 11 is a perspective view of the blast housing with a recapture assembly constructed in accordance with the present invention.

FIG. 11 illustrates a preferred embodiment of the recapture assembly 130 attached to the blast housing 52. The recapture assembly 130 utilizes a magnetic pickup assembly and an abrasive material which is drawn to a magnetic field. As shown in FIG. 11, the recapture assembly 130 comprises a pickup tray 132, a recapture bin 134, and a recapture elevator 136.

The recapture bin 134 is attached to the rear of the blast housing 52. A set of wheels or rollers (not shown) are attached to the underside of the recapture bin 134 to facilitate movement of the recapture bin 134 over the surface 12. The top of the recapture bin 134 is open to receive abrasive material. An angular trough 138 extends from the top edge of the recapture bin 134 to prevent spillage of abrasive material being deposited into the recapture bin 134. As shown in FIG. 11, a recapture auger 140 is mounted within the recapture bin 134 to rotate and carry abrasive material in the recapture bin 134 toward the recapture elevator 136.

Continuing to refer to FIG. 11, the pickup tray 132 is preferably made of stainless steel and is pivotally attached to the recapture bin 134 a pivot arm 142 at each end. A magnetic insert 144 fits inside the pickup tray 132 and is adapted to pivot into and out of the pickup tray 132. The bottom of the pickup tray 132 is sufficiently thin and the magnetic field of the magnetic insert 144 is sufficiently great to cause the abrasive material to adhere to the bottom of the pickup tray 132 when the pickup tray 132 is drawn over the abrasive material.

The recapture elevator 136 extends between the recapture bin 134 and the return chamber 66 of the blast housing 52. The recapture elevator 136 may utilize a belt and bucket arrangement or an auger for lifting abrasive material from the lower end of the recapture elevator 136 to the upper end of the recapture elevator 136. As shown in FIG. 11, the lower end of the recapture elevator 136 is mounted to and communicates with one end of the recapture bin 134 while the upper end of the recapture elevator 136 is mounted to the blast housing 52 and connects into the return chamber 66.

Figure 12:
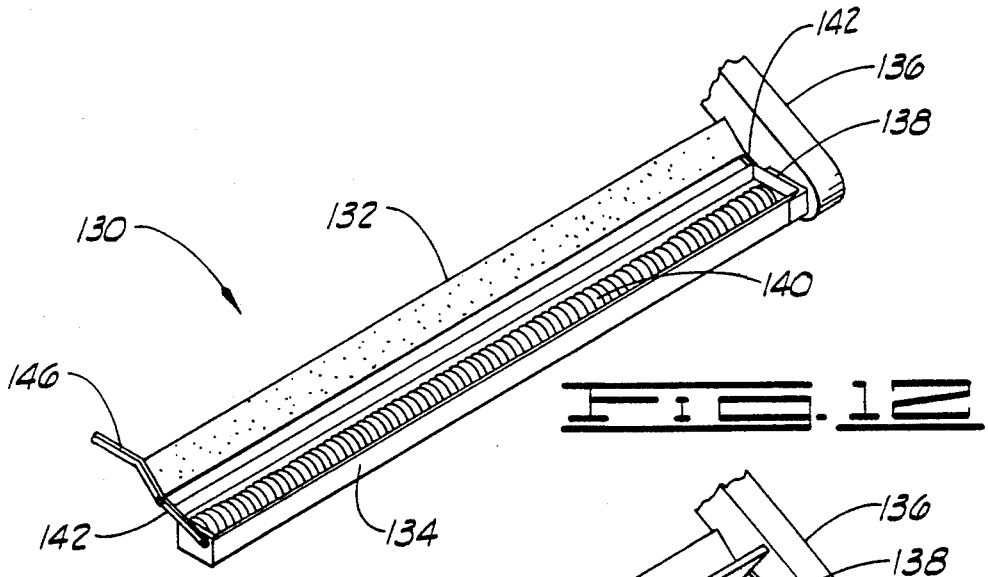
FIG. 12 is a perspective view of the recapture assembly of FIG. 11 with the pickup tray and magnetic insert pivoted together over the recapture bin.
Figure 13:
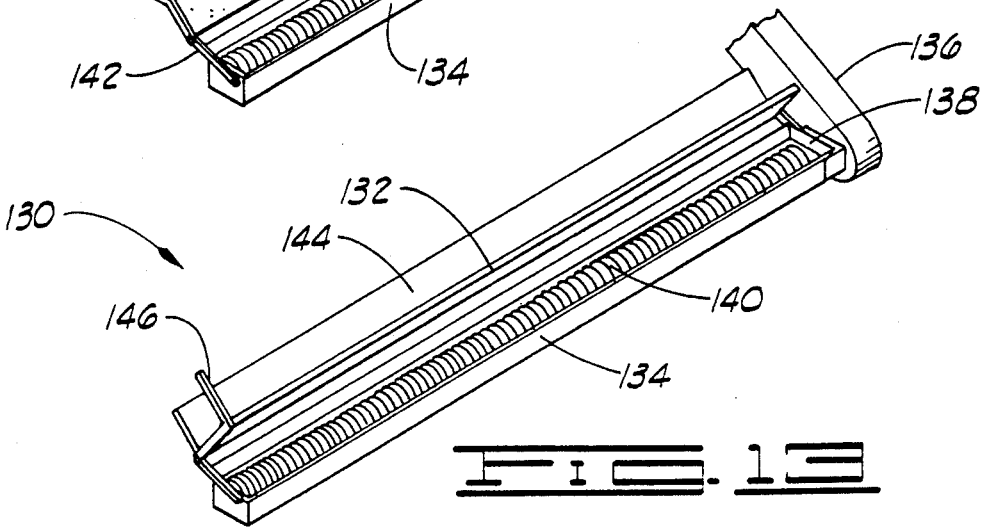
FIG. 13 is a perspective view of the recapture assembly of FIG. 11 with the pickup tray and magnetic insert pivoted over the recapture bin but separated from each other to release abrasive material into the recapture bin.

FIGS. 11, 12 and 13 illustrate the recapture of abrasive material by the recapture assembly. In the position shown in FIG. 11, abrasive material adheres to the bottom of the pickup tray 132 by the force of the magnetic field of the magnetic insert 144 through the bottom of the pickup tray 132. Using a handle 146 attached to the pickup tray 132, the pickup tray 132 containing the magnetic insert 144 is pivoted back over the open top of the recapture bin 134 to the position shown in FIG. 12. With the magnetic insert 144 held stationary, the pickup tray 132 is then pivoted to the position shown in FIG. 13. Separated from the pickup tray 132, the magnetic field of the magnetic insert 144 is no longer strong enough to hold the abrasive material to the bottom of the pickup tray 132, and the abrasive material falls into the recapture bin 134. With this construction, the magnetic insert 144 may comprise either permanent magnets or electromagnets.

After the abrasive material is deposited into the recapture bin 134, the recapture auger 140 conveys the abrasive material into the lower end of the recapture elevator 136. The recapture elevator 136 transfers the abrasive material into the return chamber 66 of the blast housing 52. Once inside the return chamber 66, the abrasive material is handled for reuse in the manner described hereinabove.

Figure 14:
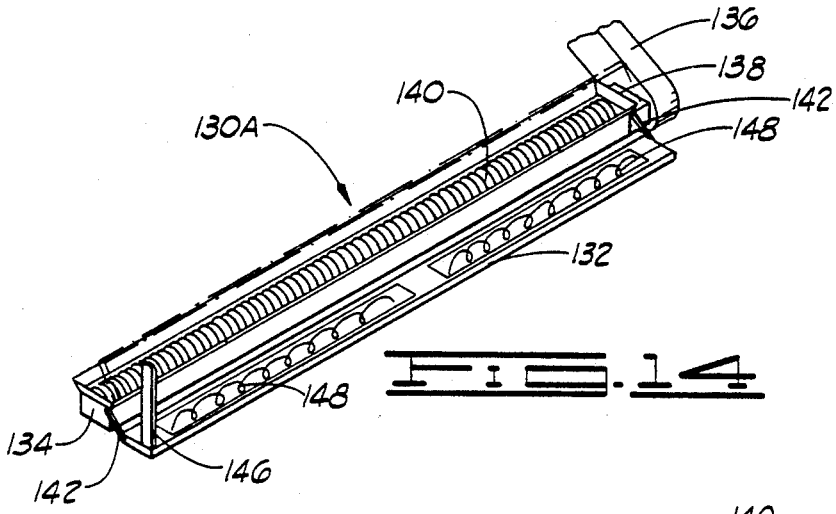
FIG. 14 is a perspective view of a manually operated electromagnetic recapture assembly.

Embodiment of FIG. 14

Referring now to FIG. 14, reference character 130A designates a preferred embodiment of electromagnetic pickup and return. In this particular embodiment, a plurality of electromagnets are secured in the pickup tray 132. Reference numeral 148 designates one of the electromagnets and is generally representative of the electromagnets mounted in the pickup tray 132. The electromagnets 148 are magnetized and de-magnetized through circuitry and controls between the operator's console 40 and the electromagnets 148 in a conventional manner. In FIG. 14, the electrical connections between the recapture assembly 130A and the console 40 are not shown for clarity of illustration. To pick up abrasive material, the electromagnets 148 are magnetized and the bottom of the pickup tray 132 attracts abrasive material as the pickup tray 132 travels over the surface 12. To deposit abrasive material into the recapture bin 134, the pickup tray 132 and electromagnets 148 are manually pivoted over the recapture bin 134. The electromagnets 148 are then de-magnetized and the abrasive material falls from the bottom of the pickup tray 132 into the recapture bin 134.

Figure 15:
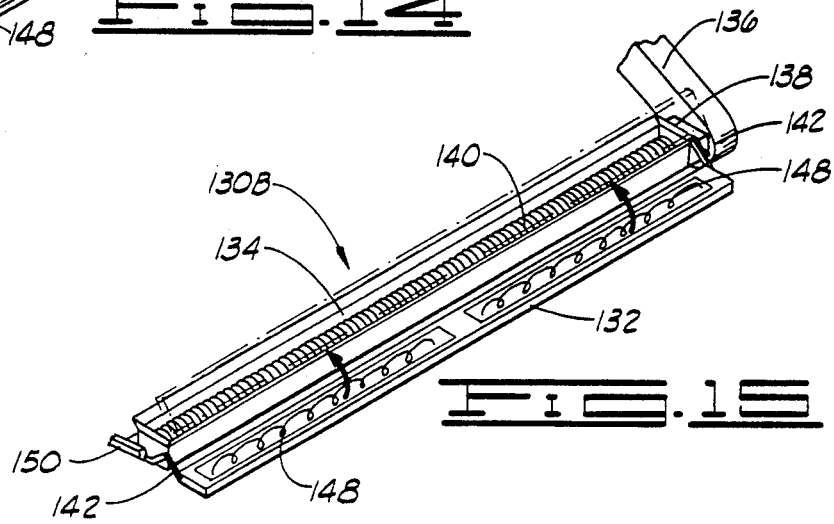
FIG. 15 is a perspective view of a remotely operated electromagnetic recapture assembly.

Embodiment of FIG. 15

FIG. 15 illustrates another embodiment of electromagnetic pickup 130B. This particular embodiment is exactly like the electromagnetic pickup 130A, except that the pivoting movement of the pickup tray 132 is remotely controlled. An actuator arm 150 mounted to each end of the pickup tray 132 (only one actuator arm 150 is visible in FIG. 15). Each actuator arm 150 is electrically connected to the controls of the operator console 40 in a conventional manner to pivot the pickup tray 132 between the depositing position over the recapture bin 134 and the pickup position with the bottom of the pickup tray 132 traveling over the surface 12. For purposes of clarity, the electrical connections between the actuator arms 150 and the console 40 are not shown in FIG. 15. From the operator console 40, the operator may pivot the pickup tray 132 with the electromagnets 148 over the recapture bin 134 and switch off the magnetic field of the electromagnets 148 to release the abrasive material into the recapture bin 134.

Figure 16:
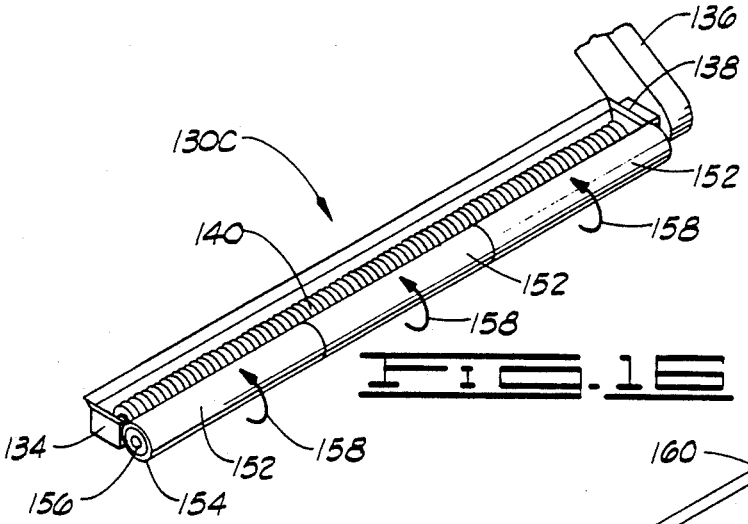
FIG. 16 is a perspective view of a recapture assembly utilizing magnetized rollers.

Embodiment of FIG. 16

Referring now to FIG. 16, reference character 130C designates yet another embodiment of magnetic pickup. In this particular embodiment, a plurality of magnetic rollers 152 are utilized. Each roller 152 comprises a rotating outer cylinder 154 around a stationary inner cylinder 156. The inner cylinders 156 are magnetized from the point of contact with the surface (the six o'clock position) counter-clockwise to the, point adjacent to the upper edge of the recapture bin 134 (the eleven o'clock position). The outer cylinders 154 are not themselves magnetized, but allow the magnetic field of the inner cylinders 156 to collect abrasive material on the exterior of the outer cylinders 154. The outer cylinders 154 turn in the direction indicated by the arrows 158 as the recapture assembly 130C is pulled over the surface 12 to be cleaned. As the outer cylinders 154 roll over the surface 12, therefore, the outer cylinders 154 magnetically pick up abrasive material at six o'clock and carry the abrasive material counter-clockwise to eleven o'clock. At eleven o'clock the magnetic field of the inner cylinders 156 ends, and the abrasive material is released from the outer cylinders 154 into the recapture bin 134.

Figure 17:
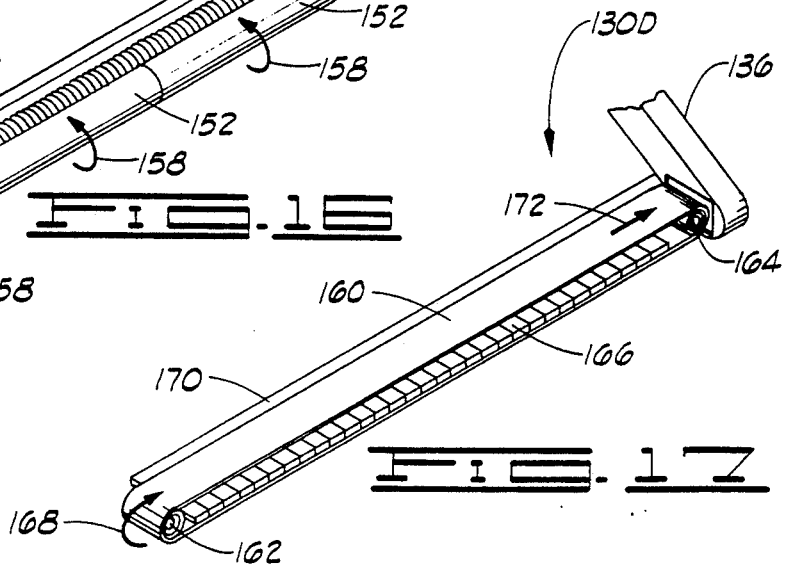
FIG. 17 is a respective view of a recapture assembly with a magnetized conveyor belt.
Figure 1B:
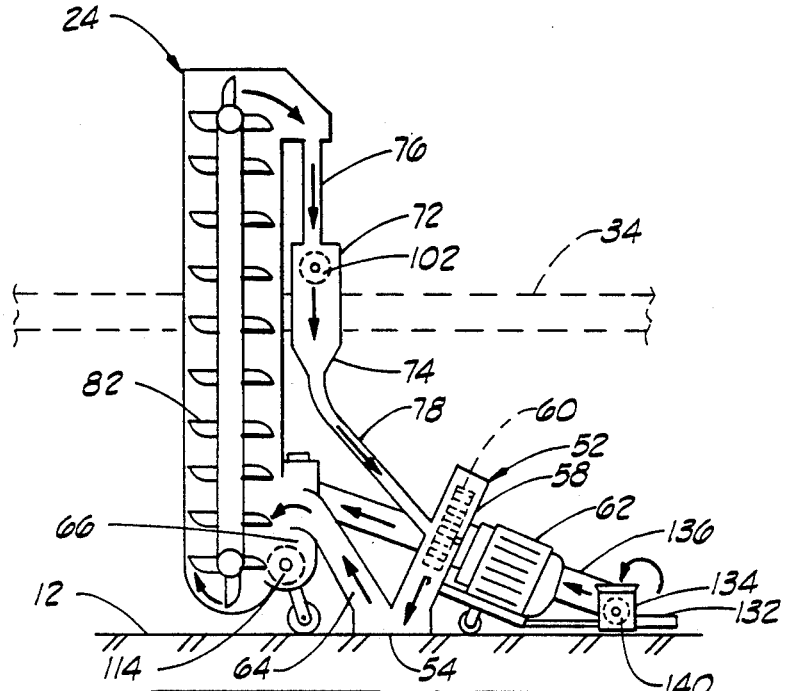
Figure 1B:
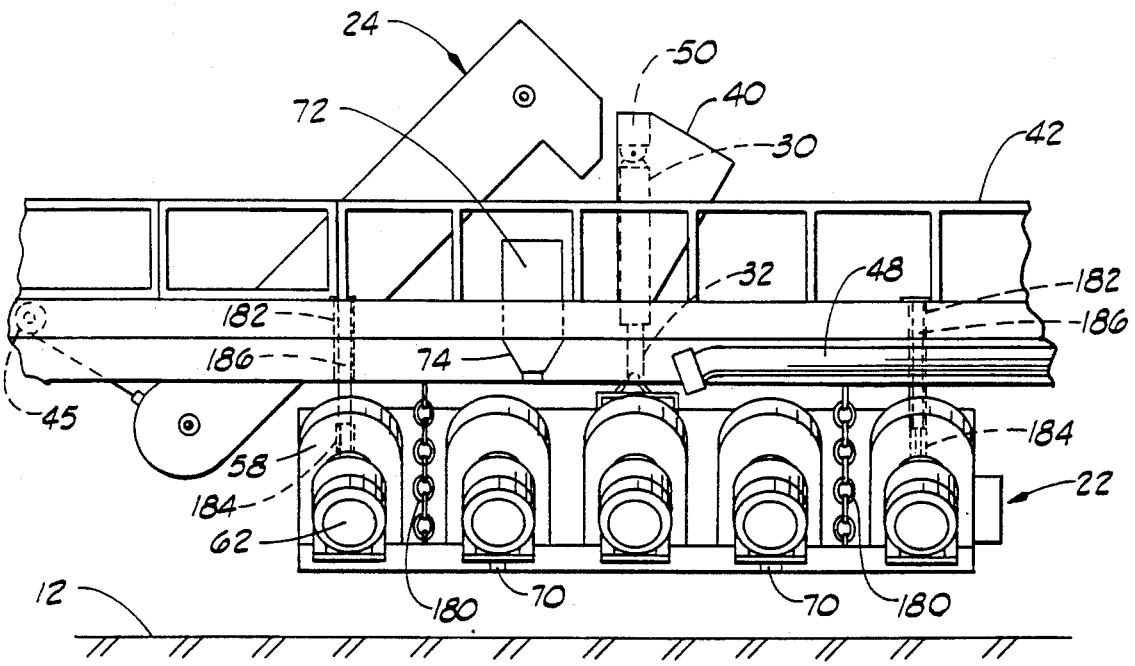

Embodiment of FIG. 17

FIG. 17 illustrates still another preferred embodiment 130D of magnetic pickup. This particular embodiment utilizes a continuous conveyor belt 160. A magnetized idler roller 162 drives the conveyor belt 160 at the end opposite the recapture elevator 136 and a non-magnetic idler roller 164 drives the conveyor belt 160 at the end adjacent to the recapture elevator 136. The motors and electrical connections for powering the idler rollers 162 and 164 are not shown for purposes of simplicity. A plurality of stationary magnets extends along the lower leg of the conveyor belt 160 between the two idler rollers 162 and 164. One of the stationary magnets is designated by reference numeral 166 and is generally representative of the plurality of stationary magnets.

In operation, the conveyor belt 160 rotates in the direction indicated by arrow 168. The stationary magnets 166 cause abrasive material to adhere to the underside of the lower leg of the conveyor belt 160. When abrasive material adhering to the conveyor belt 160 nears the magnetic idler roller 162, the magnetic idler roller 162 retains magnetic hold on the abrasive material until the abrasive material is on the top side of the upper leg of the conveyor belt 160. In order to retain abrasive material, the upper leg of the conveyor belt 160 may be magnetized in a manner similar to that described for the lower leg. The upper leg of the conveyor belt 160 may also be framed by a retaining plate 170 in order to keep abrasive material from falling off the upper leg of the conveyor belt 160. Finally, the abrasive material arrives at the non-magnetic idler roller 164 where there is no longer a magnetic field to hold the abrasive material to the conveyor belt 160. The abrasive material then is simply conveyed off the conveyor belt 160 and into the lower end of the recapture elevator 136 as indicated by direction arrow 172.

FIG. 18 diagrammatically illustrates the flow path of abrasive material through the supply bin 72, the feed hoppers 74, the feed tubes 78, the blast housing 52 and the elevator 24. The relative position of the trailer frame 34 is indicated by dashed lines. Starting at the supply bin 72, the abrasive material descends by gravity through the feed hoppers 74 and feed tubes 78 to the blast housing 52. The centrifugal blast wheel 60 propels the abrasive material through the blast opening 54 of the blast housing 52 to strike the surface 12 to be cleaned. Rebounding from the surface 12, the abrasive material enters the return corridor 64 of the blast housing 52. Air flow from the dust collector 26 takes over to draw the abrasive material into the upper end of the return corridor 64. The deflection plates 67 in the upper end of the return corridor 64 direct the abrasive material into the return chamber 66. The return auger 114 carries the abrasive material to the lower end of the elevator 24. The rotating belt and bucket assembly 82 in the elevator 24 then picks up the abrasive material in the lower end of the elevator 24 and carries the abrasive material to the upper end of the elevator 24. The abrasive material passes through the resupply duct 76 and into the supply bin 72 for reuse.

FIG. 18 also shows attachment of the recapture assembly 130 for picking up and returning abrasive material which escapes the blast housing 52. The pickup tray 132 collects the loose abrasive material and deposits the abrasive material into the recapture bin 134. The recapture auger 140 and recapture elevator 136 cooperate to transfer the recaptured abrasive material into the return chamber 66 for travel back to the supply bin 72 as previously described. It should be appreciated that any of the various preferred embodiments 130A–130B–130C–130D of the recapture assembly 130 may be utilized with the blast housing 52 for recapturing abrasive material which escapes the blast housing 52.

TRANSPORT MODE

FIG. 19 illustrates a portion of the apparatus 10 configured in the transport mode. In the transport mode, the resupply duct 76, feed tubes 78 and dust ducts 80*a* and 80*b* are removed. The elevator 24 is disconnected from the blast housing 52 and the winch 45 is used to draw the lower end of the elevator 24 toward the underside of the frame 34 to place the elevator 24 in the inclined position. As shown in FIG. 19, the inclined position of the elevator 24 moves the lower end of the elevator 24 to free a space into which the blast assembly 22 is rotated. The piston 32 of the hydraulic cylinder 30 is retracted to pull the blast assembly 22 from the surface 12 toward the underside of the frame 34. The blast assembly 22 is manually rotated into the transport position. A pair of support chains 180 are removably attached between the frame 34 and the blast assembly 22 to support the blast assembly 22 in the transport position.

A pair of securing tubes 182, one in front of the operator's console 40 and one behind the operator's console 40, extend through the trailer frame 34. A securing pipe 184 is rigidly attached to the blast assembly 22 toward each end of the blast assembly 22. Each securing pipe 184 extends upward to align with one of the securing tubes 182 through the frame 34 when the blast assembly 22 is rotated into the transport position. A securing rod 186 is inserted through each securing tube 182 and into the respective securing pipe 184 of the blast assembly 22 to keep the blast assembly 22 from rotating out of the transport position.

Once the blast assembly 22 is secured in the transporting position, the power take-off of the truck 14 is disengaged so that the truck 14 no longer drives the hydraulic system 18. The drive chain is removed from the drive shafts of the hydraulic system 18 and the truck 14. The apparatus 10 is then configured for travel to another location.

Figure 20:
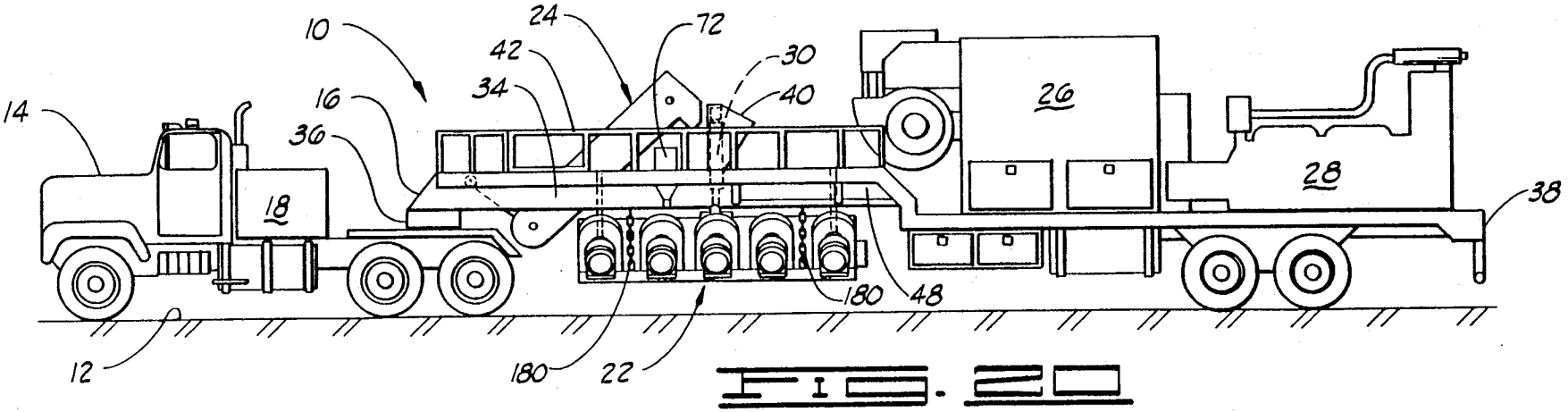
FIG. 20 is a side elevation of an apparatus constructed in accordance with the present invention and configured in transport mode.
Figure 21:
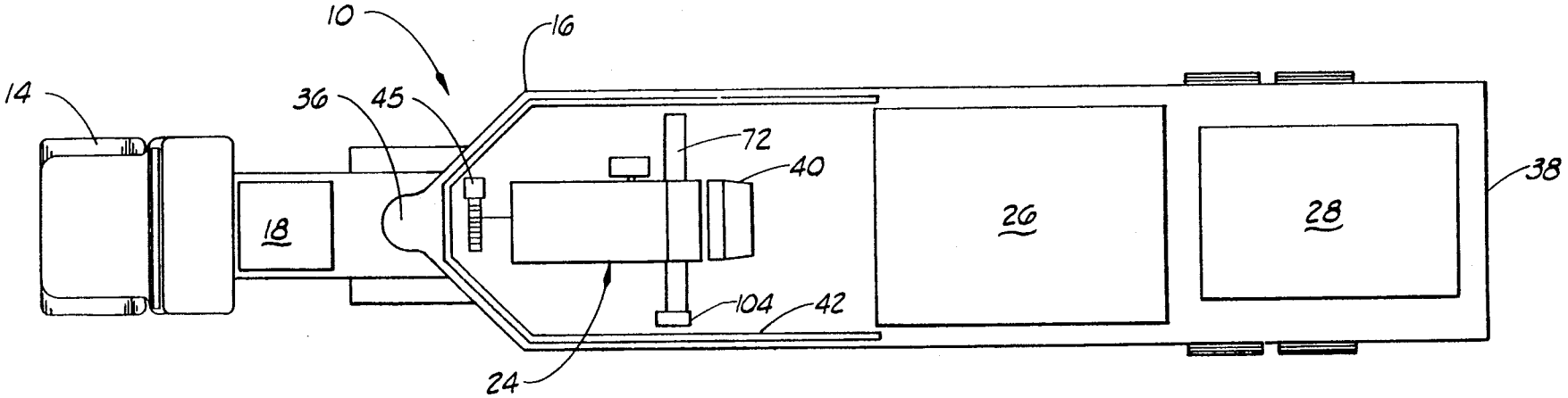
FIG. 21 is a top plan view of FIG. 20.

FIGS. 20 and 21 illustrate the apparatus 10 in transport mode. As best shown in FIG. 20, the lower end of the elevator 24 is drawn toward the front of the frame 34 to place the elevator 24 in a tilted position. The blast assembly 22 is raised from the surface 12 toward the trailer frame 34. As best shown in FIG. 21, the blast assembly 22 in transport mode is entirely beneath the width of the trailer 16.

AUTOMATIC LEVELING

Referring now to FIGS. 22 through 25, another embodiment of the apparatus 10 is illustrated. In this particular embodiment, the apparatus 10 is utilized to level a surface 12 which has uneven areas by selectively blasting any high spots occurring in a portion of the blast area defined by the blast opening 54.

Figure 22:
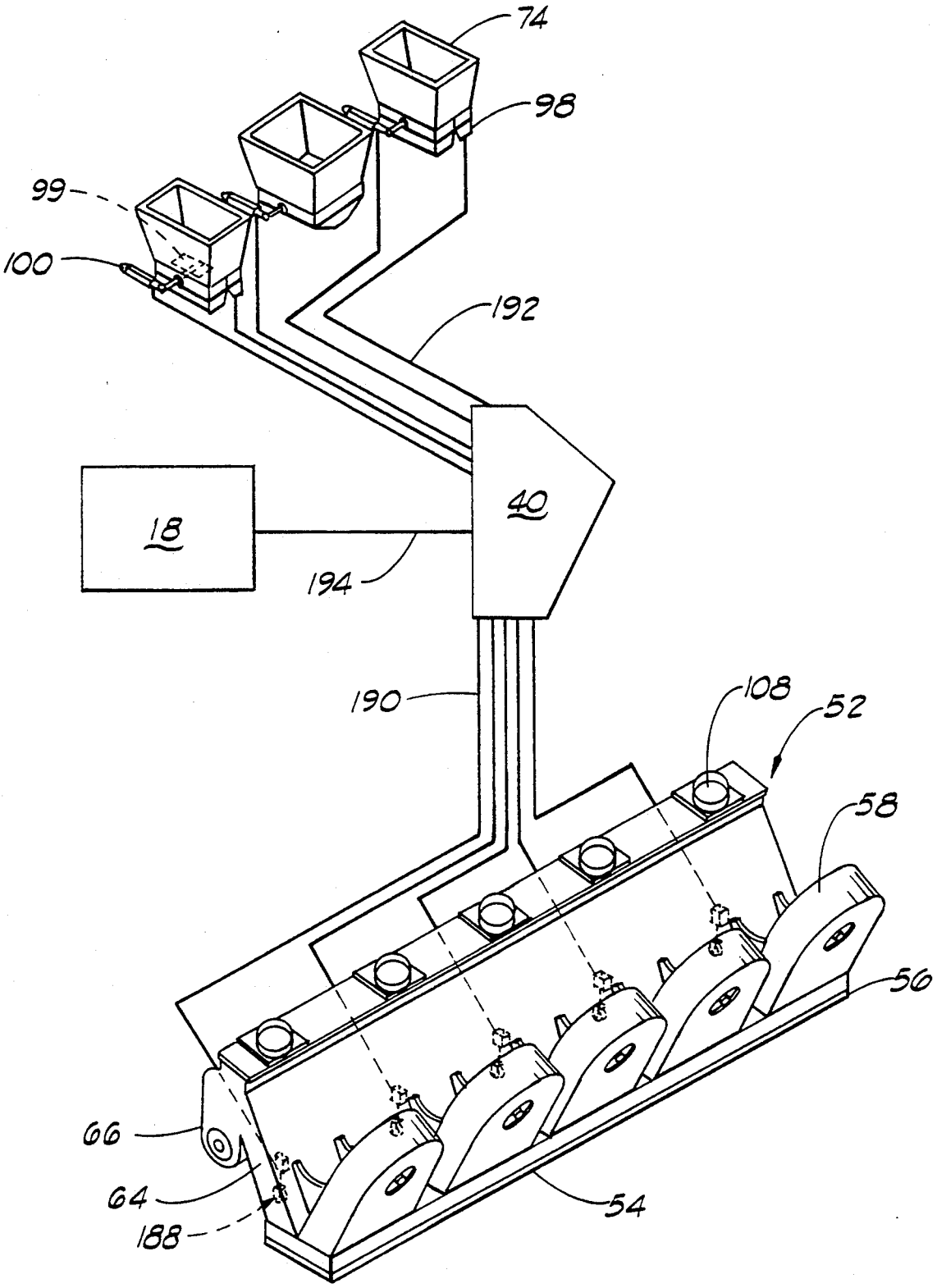
FIG. 22 is a partly diagrammatical, perspective view of a preferred embodiment of the present invention including grade sensors for leveling an uneven surface.

In order to perform the leveling function, a plurality of grade sensors are attached to the blast housing 52 in front of the blast opening 54 as shown in FIG. 22. One of the grade sensors is designated by reference number 188 and is generally representative of the grade sensors. Each grade sensor 188 corresponds to one of the blast wheels 60 and to the feed hopper discharge chute 98 feeding abrasive material to that blast wheel 60.

As illustrated by FIG. 22, each grade sensor 188 is connected to the operator's console 40 by control cables 190. It should be understood that the cables 190 are shown schematically in FIG. 22 and actually remain outside the blast housing 52 in extending between the grade sensors 188 and the operator's console 40. Another set of control cables 192 extends between the operator's console 40 and the actuator arm 100 of each feed hopper discharge chute 98. The console 40 and each actuator arm 100 are adapted to open and close the gate 99 of the corresponding feed hopper discharge chute 98. Yet another set of control cables 194 extend between the operator's console 40 and the hydraulic system 18 to open and close hydraulic valves to speed up and slow down the movement of the apparatus 10 over the surface 12 to be cleaned.

Figure 23:
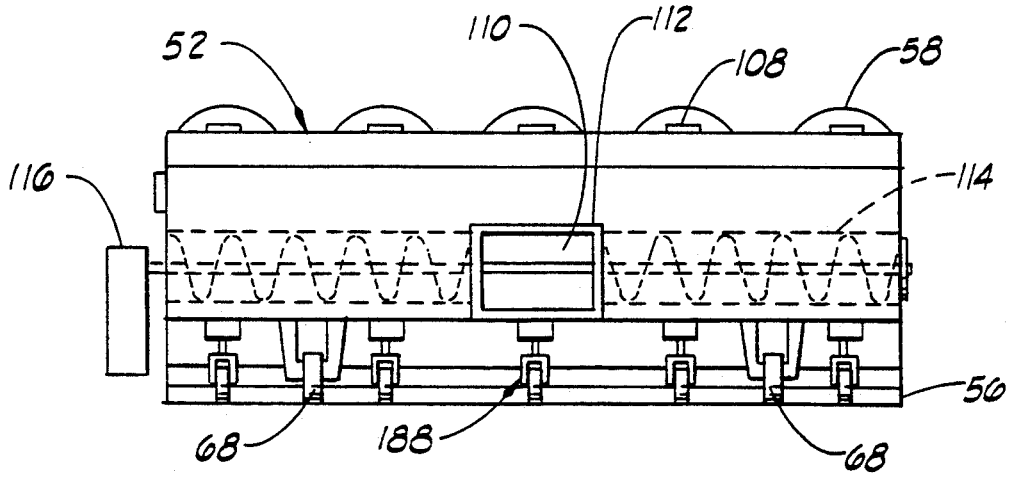
FIG. 23 is an front elevation of the blast housing of FIG. 22.

FIG. 23 further illustrates the installed positions of the grade sensors 188 on the blast housing 52. Note that the grade sensors 188, the wheels 68 supporting the blast housing 52 and the bottom of the seal 56 around the blast opening 54 substantially align in an operating plane.

Figure 24:
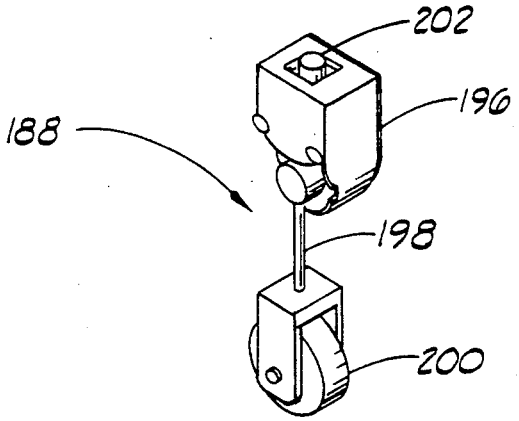
FIG. 24 is a perspective view of one of the grade sensors of FIG. 22.

FIG. 24 shows one of the grade sensors 188 separately. Each grade sensor 188 comprises a housing 196, a pivot arm 198 and a roller 200. The upper end of the pivot arm 198 is pivotally attached to the housing 196 and the roller 200 is connected to the lower end of the pivot arm 198. The roller 200 is free to rotate at the lower end of the pivot arm 198. The housing 196 contains mechanical and electrical components which produce varying electrical outputs in response to the position of the pivot arm 198. The housing 196 of each grade sensor 188 includes an electrical connector 202 for attachment of one of the control cables 190.

A suitable grade sensor 188 is an adaptation of the electrohydraulic valve controller model 100, available from P-Q Controls in Bristol, Conn. This valve controller is designed to convert the manual inputs into proportional electric output signals for driving electrically operated proportional control valves. The pivot arm 198 is normally a control handle with an attached knob. For use with the apparatus 10, however, the knob is replaced by the roller 200, as shown in FIG. 24.

Figure 25:
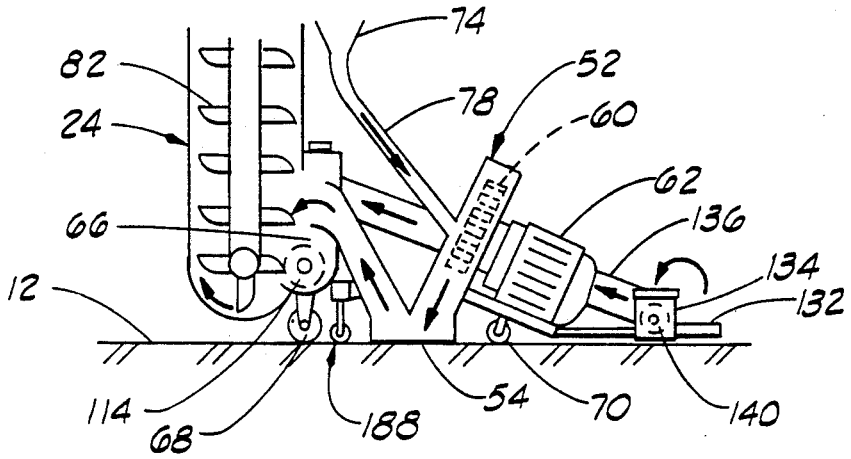
FIG. 25 is a partly diagrammatical side view of a portion of the apparatus including grade sensors and a recapture assembly.

As best shown in FIGS. 23 and 25, the front wheels 68 and rear wheels 70 of the blast housing 52 define an operating plane. The surface 12 under the blast housing 52 lies substantially in the operating plane with the resilient seal 56 of the blast housing 52 in close proximity or in contact with the surface 12. If the surface 12 is even across the blast housing 52, the rollers 200 of the grade sensors 188 roll along the surface 12 in the operating plane. If all the rollers 200 are rotating upon the operating plane, no leveling is required, and the pivot arms 198 are in a non-blasting position. It should be appreciated that in the non-blasting position, the pivot arms 198 of the grade sensors 188 extend toward the surface 12 at an offset from the perpendicular in order for the pivot arm 198 to pivot easily when the attached roller 200 encounters an area higher than the operating plane.

In operating the apparatus 10 to level uneven areas of a surface 12, the apparatus 10 is placed in operating mode except that the gates 99 of the feed hopper discharge chutes 98 are closed. The blast wheels 60 are rotating, but no abrasive material is fed to the blast wheels 60 and no blasting takes place. If the surface 12 is substantially even across the rollers 200 of the grade sensors 188, the rollers 200 move over the surface 12 without changing the position of the pivot arm 198, the output signals from the grade sensors 188 remain the same, and the gates 99 to the feed hopper discharge chutes 198 remain closed.

When one of the grade sensors 188 encounters an area which is higher than the operating plane, however, the pivot arm 198 pivots and changes the electrical output of the grade sensor 188 in proportion to the movement of the pivot arm 198. As shown in FIG. 22, control cables 190 conduct the electrical output of each grade sensor 188 to the operator's console 40. In this embodiment, the operator's console 40 includes conventional control circuitry to relate the electrical output of each grade sensor 188 to an operating position for the gate 99 of the corresponding discharge chute 98. The gate 99 of each discharge chute 98 is moved to different positions electrically through the respective control cable 192 and actuator arm 100. Accordingly, the higher the uneven area, the more the pivot arm 198 moves, and the more the gate 99 of the respective discharge chute 98 opens. The amount of abrasive material fed to each blast wheel 60, therefore, is proportional to the deviation of the corresponding grade sensor 188 above the operating plane.

The electrical output of the grade sensors 188 is also interpreted by the conventional circuitry of the operator's console 40 to interface with the hydraulics system 18. When at least one of the grade sensors 188 detects a high uneven area, the electrical output is relayed through the control cable 194 to the electro-hydraulic controller of the hydraulic system 18 to operate a hydraulic valve and slow the apparatus 10 to a selected blasting speed of travel. When the electrical output of the grade sensors 188 indicates that there are no high uneven areas, the electro-hydraulic controller of the hydraulic system 18 is signalled to return the apparatus 10 to the selected non-blasting speed of travel.

Although the electrical, hydraulic and air flow arrangements disclosed hereinabove are preferred, various combinations of hydraulic, electrical and pneumatic energy may be employed to operate the components of the apparatus 10 in an acceptable manner. Changes may be made in the combinations, operations and arrangements of the various parts and elements described herein without departing from the spirit and scope of the invention as defined in the following claims.

What is claimed is:

1. An apparatus for cleaning a surface, the apparatus comprising:

a truck;

a trailer including a wheeled frame adapted to be attached to said truck and drawn by said truck over a surface to be cleaned;

a blast housing rotatably mounted under the frame, said blast housing having a blast opening and a plurality of blast corridors, each blast corridor having an upper end and a lower end, wherein the lower end of each blast corridor communicates with the blast opening;

a plurality of blast wheels installed in said blast housing, each blast wheel corresponding to one of said blast corridors and adapted to propel abrasive material through the corresponding blast corridor and through the blast opening to strike the surface to be cleaned; and means for moving said blast housing between an operating position wherein said blast housing is lowered to the surface to be cleaned and said blast housing is rotated to extend laterally beyond the trailer frame, and a transport position wherein said blast housing is spaced a distance from the surface to be cleaned and said blast housing is rotated to be entirely beneath the trailer frame.

2. The apparatus of claim 1 wherein said blast wheels are installed in said blast housing in a straight line.

3. The apparatus of claim 1 further comprising:

a return corridor within said blast housing and having an upper end and a lower end, the lower end of said return corridor communicating with the blast opening;

a return chamber within said blast housing, said return chamber communicating with said return corridor to receive abrasive material from said return corridor and having a return discharge opening for discharging abrasive material from said blast housing;

a plurality of feed hoppers, each feed hopper communicating with the upper end of at least one blast corridor to supply abrasive material to said blast corridors; and an elevator assembly having an upper end and a lower end, wherein the lower end of said elevator assembly communicates with the return discharge opening to receive abrasive material from said return chamber and the upper end of said elevator assembly communicates with said feed hoppers to deposit abrasive material into said feed hoppers.

4. The apparatus of claim 3 further comprising:

a return auger rotatably mounted within said return chamber to convey abrasive material within said return chamber to the return discharge opening; and a return auger motor connected to said return auger to provide rotation to said return auger.

5. The apparatus of claim 3 wherein said elevator assembly further comprises:

an elevator housing having an upper end and a lower end, wherein the upper end of said elevator housing has an elevator outlet communicating with said feed hoppers and the lower end of said elevator housing has an elevator inlet communicating with the return discharge opening;

a belt disposed within said elevator housing and formed into a loop with an inner surface and an outer surface;

a plurality of buckets attached to the outer surface of said belt; and an elevator motor mounted to said elevator housing and adapted to rotate said belt to capture abrasive material at the elevator inlet and carry the abrasive material to the elevator outlet.

6. The apparatus of claim 3 further comprising:

a winch assembly attached to said frame for tilting said elevator assembly between an operating position wherein the lower end of said elevator assembly is proximate to the surface to be cleaned and a transporting position wherein the lower end of said elevator assembly is tilted away from the surface to be cleaned.

7. The apparatus of claim 3 further comprising:

a gate mounted in each discharge chute of each feed hopper, each gate having an actuator arm for opening and closing said gate to regulate the amount of abrasive material being fed through the respective discharge chute to the corresponding blast wheel.

8. The apparatus of claim 7 further comprising:

a plurality of grade sensors attached to said blast housing, each grade sensor having a pivotally attached pivot arm with a roller adapted to travel over the surface to be cleaned, wherein each grade sensor includes means for producing an electrical output proportional to the pivot position of said pivot arm of the grade sensor; and gate control means for positioning said gate of each discharge chute in proportional response to the electrical output of the corresponding grade sensor.

9. The apparatus of claim 3 further comprising:

a supply bin mounted to said frame between said elevator assembly and said feed hoppers, said supply bin communicating with said elevator assembly to receive abrasive material from said elevator assembly and communicating with said feed hoppers to supply said feed hoppers with abrasive material.

10. The apparatus of claim 9 further comprising:

a supply auger mounted within said supply bin to distribute abrasive material to said feed hoppers.

11. The apparatus of claim 3 further comprising:

a dust collector mounted on said frame; and means for removing dust from said dust collector;

wherein said dust collector is connected to the upper end of said return corridor to create a flow of air from the blast opening through said return corridor into said dust collector.

12. The apparatus of claim 11 wherein said dust collector is connected to said elevator assembly to provide an air wash for said elevator assembly.

13. The apparatus of claim 11 further comprising:

a power generator mounted on said frame and electrically connected to and supplying power to said blast wheels, said dust collector, said winch assembly, said elevator motor, and said return auger motor.

14. The apparatus of claim 1 further comprising:

a resilient seal attached to said blast housing around the blast opening to prevent leakage of abrasive material between said blast housing and the surface to be cleaned.

15. The apparatus of claim 1 further comprising:

magnetic means, attached to said blast housing, for picking up abrasive material escaping said blast housing.

16. The apparatus of claim 15 further comprising:

means for conveying abrasive material from the magnetic means back into said blast housing.

17. The apparatus of claim 1 further comprising:

a hydraulic system mounted on said truck;

wherein said means for moving said blast housing is a hydraulic cylinder operatively connected to said hydraulic system.

18. The apparatus of claim 17 wherein the rate of movement of said truck is controllable through said hydraulic system.

19. The apparatus of claim 18 further comprising:

a plurality of grade sensors attached to said blast housing, each grade sensor having a pivotally attached pivot arm with a roller adapted to travel over the surface to be cleaned, wherein each grade sensor includes means for producing an electrical output proportional to the pivot position of the pivot arm of said grade sensor; and means for speeding up and slowing down the movement of said truck in response to the electrical output of said grade sensors.

* * * * *